US005487203A

United States Patent [19]

Brach, Jr. et al.

[11] Patent Number: 5,487,203

[45] Date of Patent: Jan. 30, 1996

[54] SQUEEGEE HAVING AN ADVERTISING DISPLAY AREA

[76] Inventors: Philip L. Brach, Jr., 655 Sixth St., Hermosa Beach, Calif. 90254; Charles Khalil, 26722 Rolling Hills Rd., Rolling Hill Estates, Calif. 90274; Robert W. Mead, 655 Sixth St., Hermosa Beach, Calif. 90254

[21] Appl. No.: 179,701

[22] Filed: Jan. 11, 1994

[51] Int. Cl.[6] ..... A47L 13/11

[52] U.S. Cl. ..... 15/245; 15/143.1; 15/145; 40/586; 40/661; 16/110 R; D 8/DIG. 7; D 8/300; D32/41; D32/51; D20/19

[58] Field of Search ..... 15/245, 245.1, 15/143.1, 145, 236.01, 236.02, 244.1, 244.2; D32/40, 41, 42, 43, 51, 52, 49; D8/300, 301, 322, 499, DIG. 7; D20/19, 22; 16/110.2, 114.2; 40/586, 314, 630, 625, 638, 913, 905, 661

[56] References Cited

U.S. PATENT DOCUMENTS

| | | | |
|---|---|---|---|
| 165,147 | 7/1875 | Baldwin | 40/661 |
| 2,814,818 | 12/1957 | Birse | 15/143.1 |
| 3,229,316 | 1/1966 | Matheson | D 32/49 |
| 4,124,915 | 11/1978 | Schlicher | 15/245 |
| 4,524,478 | 6/1985 | Ross | 40/314 |
| 4,534,126 | 8/1985 | Gilmer | 40/661 |
| 4,589,159 | 5/1986 | Streibel | 15/143.1 |
| 4,716,616 | 1/1988 | Poon | 15/245 |
| 5,080,516 | 1/1992 | Ward | 40/661 |
| 5,144,763 | 9/1992 | Calhoun | 40/661 |

FOREIGN PATENT DOCUMENTS

| | | | |
|---|---|---|---|
| 2313003 | 12/1976 | Germany | 15/245 |
| 592711 | 9/1947 | United Kingdom | 15/167.1 |
| 2050815 | 1/1981 | United Kingdom | 75/245 |

*Primary Examiner*—Gary K. Graham
*Attorney, Agent, or Firm*—O'Boyle & Gates Brady

[57] ABSTRACT

An implement handle, such as a handle for a squeegee, used for cleaning vehicle windshields, wherein a portion of the handle has a polygonal cross-section providing a plurality of flat faces forming a display area upon which advertising indicia is connected.

14 Claims, 4 Drawing Sheets

SQUEEGEE HAVING AN ADVERTISING DISPLAY AREA

BACKGROUND OF THE INVENTION

In sales marketing, it is well accepted that display advertising is quite an effective tool for convincing customers to purchase certain products. In one marketing area, such as convenience stores having a gas pump island, display advertising is quite effective since, in some instances, the customer drives to the convenience store just to purchase gas but when going into the convenience store to pay for the gas, the customer is likely to see an advertisement which might be a reminder or suggestion to buy another product in addition to the gas.

As an added convenience to the gas purchasing customers, many service stations have installed credit card point of sale terminals at the gas pump island to save the customer time paying for the gas. While this has expedited the passage of gas purchasing customers, the effectiveness of the display advertising has somewhat diminished since the customer is no longer going into the service station to pay for the gas, and thus not seeing the advertising display therein.

SUMMARY OF THE INVENTION

After considerable research and experimentation, the implement handle having an advertising display area of the present invention has been devised to extend the area of display advertising to gas pump islands at service stations.

The implement of the present invention comprises, essentially, an elongate handle having a portion which is polygonal in cross-section providing a plurality of sides having flat faces. Advertising indicia is connectable to the flat faces of the handle which is adapted to be connected to various implements, such as, a squeegee of the type used for cleaning vehicle windshields. By this construction and arrangement, the squeegee handle becomes a carrier for the advertising material which the gas purchasing customer would observe while cleaning the vehicle windshield.

DESCRIPTION OF THE PREFERRED EMBODIMENT

Figure 1:
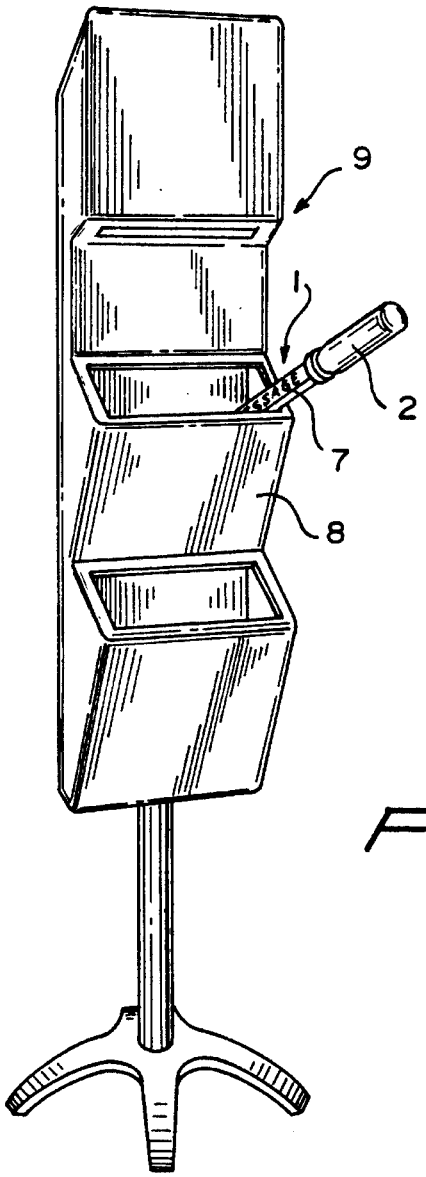
FIG. 1 is a perspective view of the implement handle of the present invention contained in a bin of a vehicle windshield washing service unit.
Figure 2:
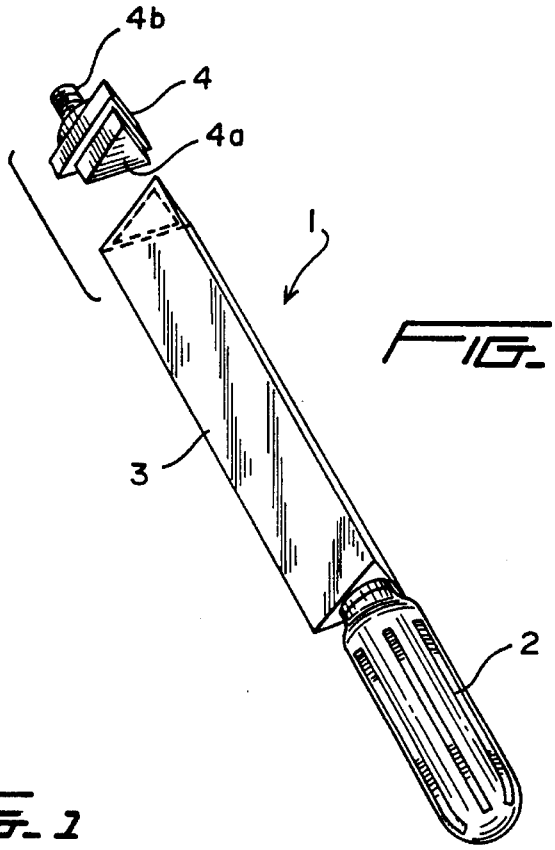
FIG. 2 is an exploded perspective view of one embodiment of the invention showing the connector employed for securing the implement onto the end of the handle.
Figure 3:
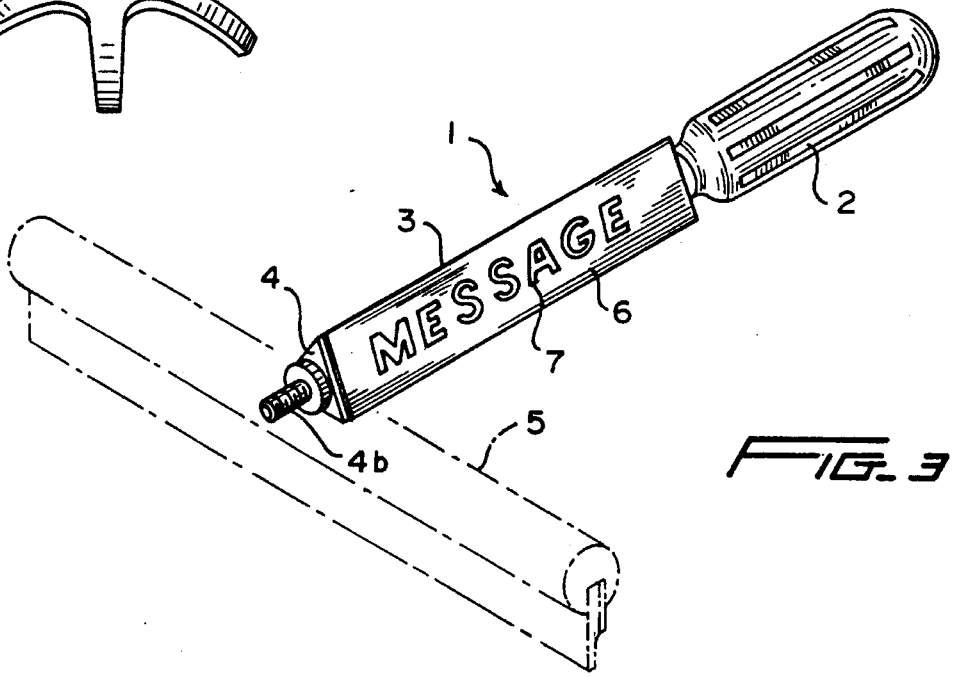
FIG. 3 is a perspective view of the handle illustrated in FIG. 2, showing, in phantom, a squeegee connected to the end thereof, and illustrating an embodiment wherein the advertising indicia is adhesively secured to a face of the polygonal portion of the handle.

Referring to the drawings and more particularly to FIGS. 1 to 3, the implement handle 1 of the present invention comprises an elongate member having a gripping end portion 2, a polygonal portion 3, and an implement connector end 4. The polygonal portion 3 of the handle is constructed of transparent plastic and is hollow for receiving the connector boss portion 4*a* which can be adhesively secured within the polygonal portion 3 of the handle. The connector 4 also includes an integral bolt 4*b* to which an implement, such as a squeegee 5, is threadably connected. While a squeegee 5 is shown connected to the handle, it is contemplated that other implements, such as an ice scraper, can also be connected to the handle 1.

A substrate 6 having advertising indicia 7 printed thereon is adhesively secured to at least one face of the polygonal portion 3 of the handle.

The polygonal portion 3 of the handle is dimensioned to provide an enlarged surface to enable the viewing of the advertising indicia 7 not only while the implement is being used but also while it is stored in the bin 8 of a vehicle windshield washing service unit 9, as shown in FIG. 1.

Figure 4:
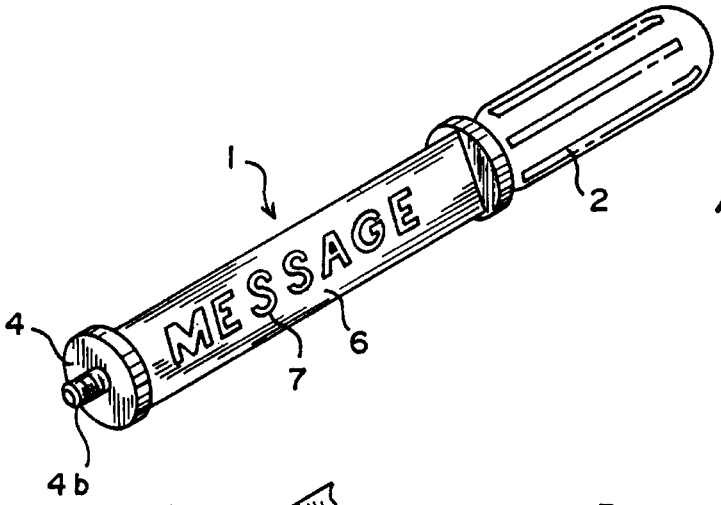
FIG. 4 is a perspective view of another embodiment of the handle.

While the polygonal portion 3 of the implement handle 1 shown in FIGS. 2 and 3 is dimensioned to extend radially outwardly beyond the periphery of gripping portion 2 and the connector end 4, FIG. 4 shows another embodiment of the handle 1 wherein the radial extent of the polygonal portion 3 is within the peripheries of the gripping portion 2 and connector end 4.

Figure 5:
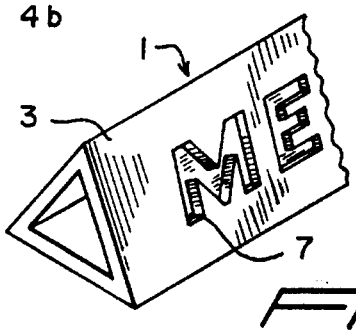
FIG. 5 is a fragmentary, perspective view of the polygonal portion of the handle showing another embodiment wherein the advertising indicia is molded therein whereby the letters of the indicia are recessed into the face of the handle.

FIG. 5 shows another embodiment of applying the advertising indicia 7 to the face of the polygonal portion 3 of the handle wherein the indicia is molded therein in such a manner that the letters of the indicia are recessed into the face of the handle.

Figure 6:
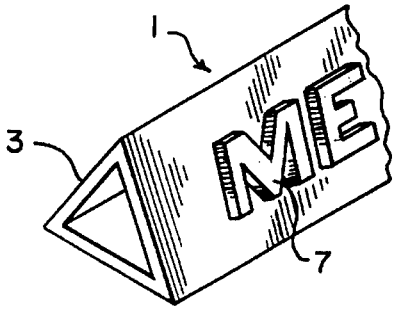
FIG. 6 is a fragmentary perspective view of the polygonal portion of the handle showing yet another embodiment wherein the advertising indicia is molded thereon whereby the letters of the indicia are raised from the face of the handle.

FIG. 6 shows yet another embodiment of applying the advertising indicia 7 to the face of the polygonal portion 3 of the handle, wherein the indicia is molded thereon in such a manner that the letters of the indicia are raised from the face of the handle.

Figure 7:
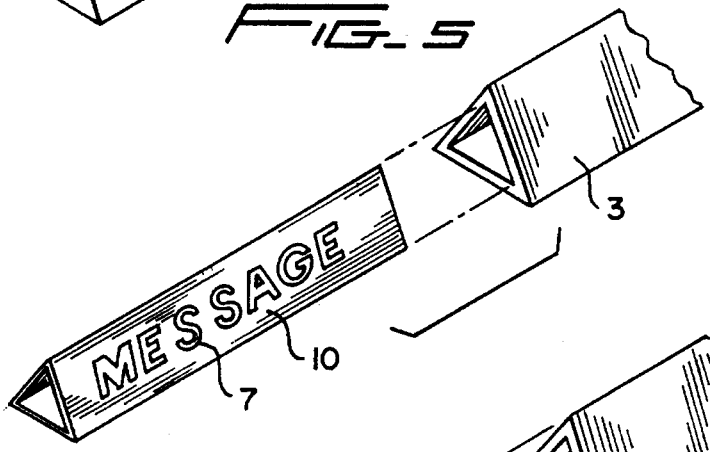
FIG. 7 is a fragmentary perspective view of the polygonal portion of the handle showing still another embodiment wherein the advertising indicia is printed on a substrate having a cross-sectional configuration corresponding to the cross-sectional configuration of a hollow, transparent handle portion, wherein the substrate carrying the advertising indicia is inserted into the handle portion.

FIG. 7 shows still another embodiment of applying the advertising indicia 7 to the polygonal portion 3 of the handle wherein the indicia 7 is printed on a substrate 10 made from paper or cardboard which is folded to a configuration corresponding to the cross-sectional configuration of the handle portion 3 and dimensioned to be slid into the transparent handle portion 3.

Figure 8:
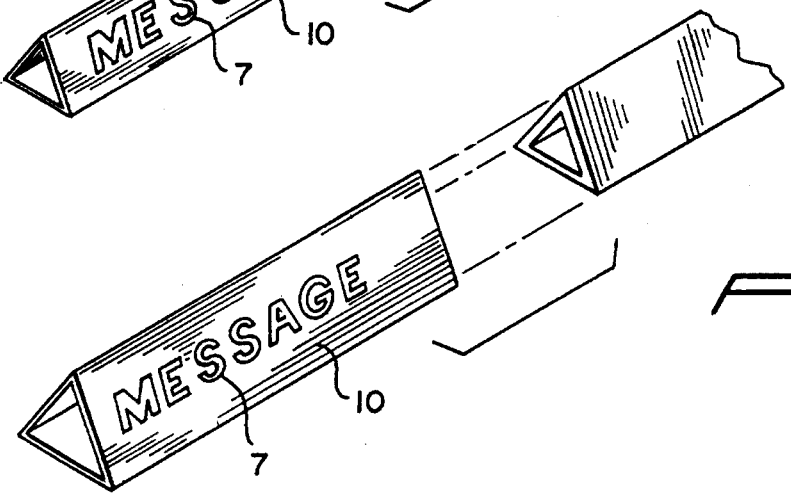
FIG. 8 is a fragmentary perspective view of the polygonal portion of the handle showing yet still another embodiment wherein the substrate carrying the advertising indicia is slipped onto the exterior surface of the polygonal portion of the handle.

FIG. 8 illustrates yet still another embodiment for applying the advertising indicia 7 to the polygonal portion 3 of the handle wherein the advertising indicia is printed on a substrate 10 similar to that shown in FIG. 5 but dimensioned to form a sleeve to be slipped onto the exterior surface of the handle portion 3.

Figure 9:
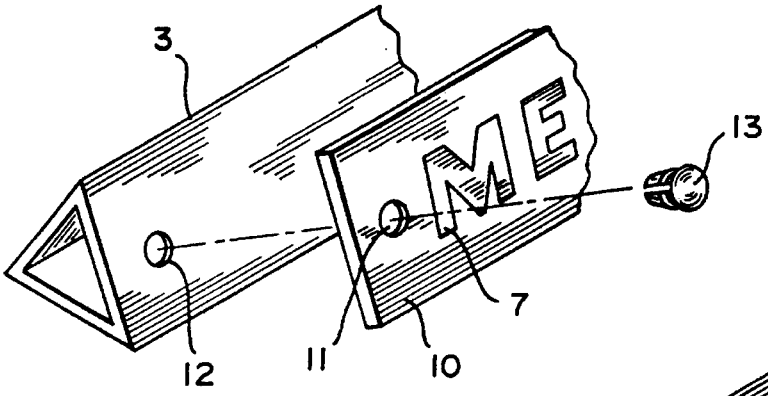
FIG. 9 is an exploded fragmentary, perspective view of another embodiment for mounting the substrate-carrying indicia on the polygonal portion of the handle wherein snap fasteners are employed.

FIG. 9 shows another embodiment for connecting the advertising indicia 7 to the handle portion 3 wherein the indicia 7 is printed on an elongate substrate 10 having holes 11 at each end thereof and adapted to be aligned with similarly positioned apertures 12 provided in the handle portion 3 through which snap fasteners 13 extend.

Figure 10:
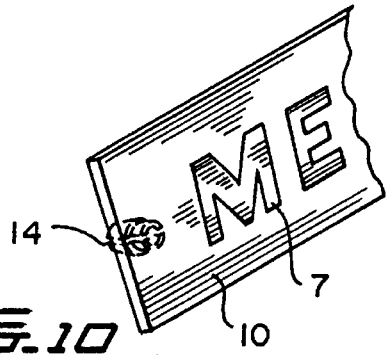
FIG. 10 is a fragmentary perspective view of the substrate-carrying indicia of FIG. 9 wherein the snap fastener is integral with the substrate.

FIG. 10 shows yet another embodiment for connecting the advertising indicia to the handle portion 3 similar to the embodiment shown in FIG. 9; however, the snap fasteners 14 are integral with the back face of the substrate 10.

Figure 11:
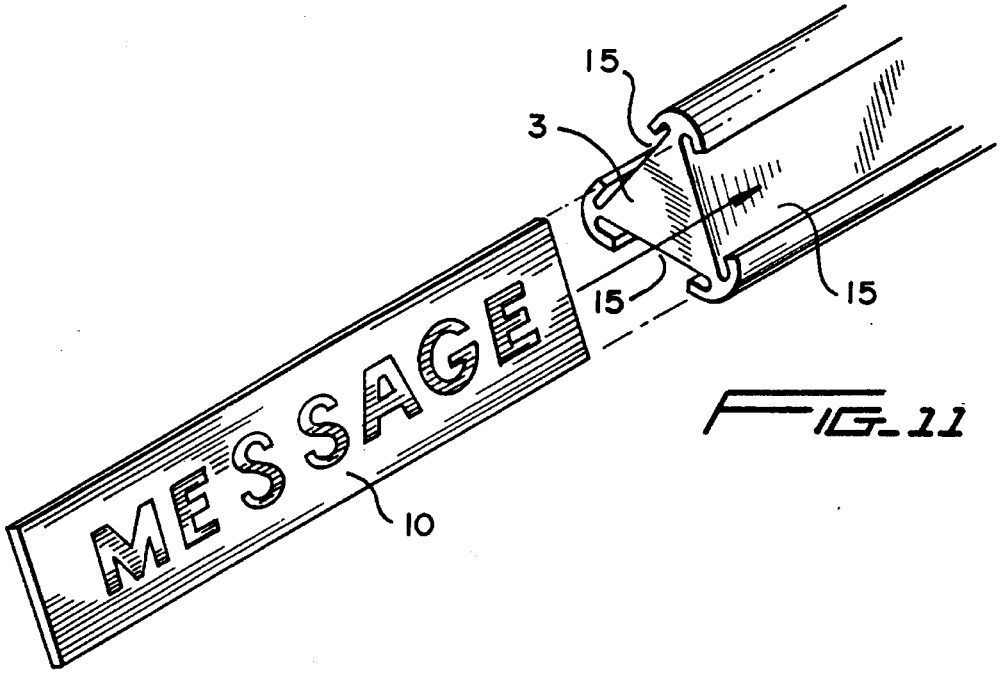
FIG. 11 is an exploded fragmentary, perspective view of the polygonal portion of the handle showing still another embodiment wherein grooves are provided in each face of the handle portion into which the advertising indicia-carrying substrate is slidably received.

FIG. 11 illustrates still another embodiment wherein the polygonal portion 3 of the handle is solid and each face is provided with a groove 15 into which the advertising indicia-carry substrate 10 is slidably mounted.

Figure 12:
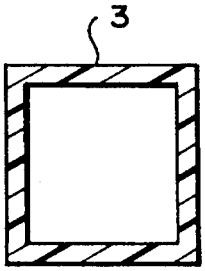
FIG. 12 is an end elevational view, in cross-section, of the polygonal portion of the handle wherein the polygonal configuration is rectangular.
Figure 13:
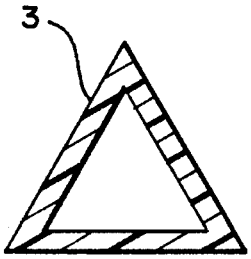
FIG. 13 is a view similar to FIG. 12 wherein the polygonal cross-sectional configuration is triangular.
Figure 14:
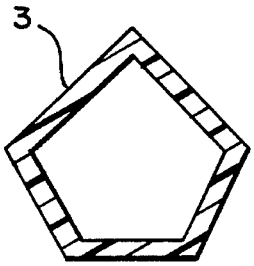
FIG. 14 is a view similar to FIG. 12 wherein the polygonal cross-sectional configuration is pentagonal.

FIGS. 12, 13 and 14 illustrate the various cross-sectional configurations contemplated for the polygonal portion 3 of the handle; viz., rectangular, triangular and pentagonal.

Figure 15:
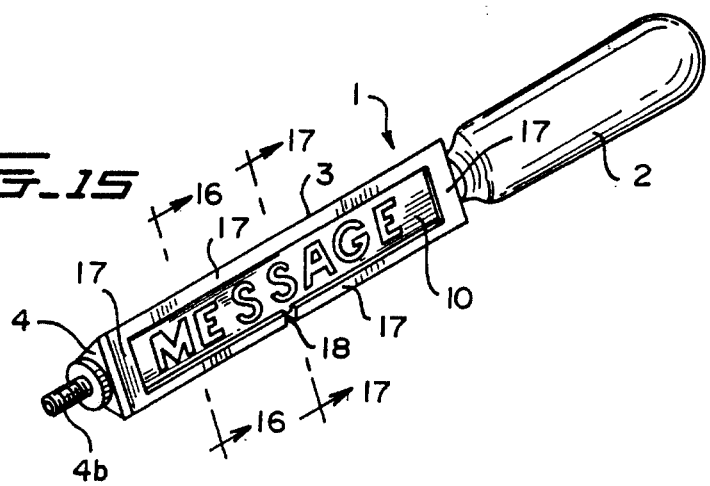
FIG. 15 is a perspective view of the handle of the present invention showing yet another embodiment wherein a face of the handle portion is formed with a rectangular recess providing a frame for holding the advertising indicia-carrying substrate on the handle.
Figure 16:
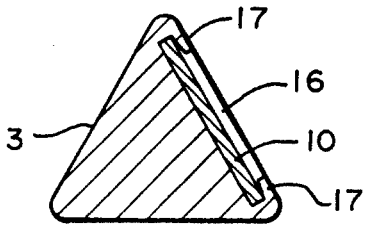
FIG. 16 is a view taken along line 16—16 of FIG. 15.
Figure 17:
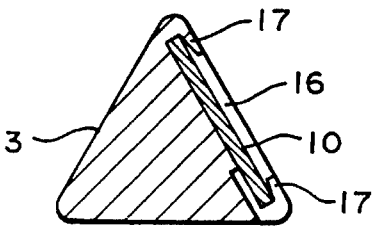
FIG. 17 is a view taken along line 17—17 of FIG. 15.

FIGS. 15, 16 and 17 illustrate yet another embodiment wherein a face of the polygonal portion 3 of the handle 1 is formed with a rectangular recess 16 having an inwardly extending peripheral flange 17 providing a frame for retaining the advertising indicia-carrying substrate 10 within the recess 16.

Figure 18:
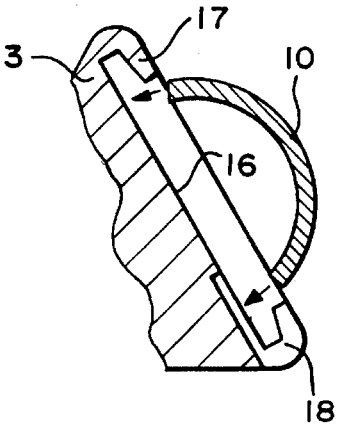
FIG. 18 is a fragmentary, sectional end view of the polygonal portion of the handle shown in FIG. 15 illustrating the insertion of the indicia-carry substrate into the rectangular recess.

To insert the substrate 10 into the framed recess 16, the substrate 10 is resilient and manually bent as shown in FIG. 18 to decrease the width of the substrate to be inserted underneath the frame 17. The substrate 16 is then released so that the longitudinal edges extend behind the flange 17 as shown in FIGS. 16 and 17.

Figure 19:
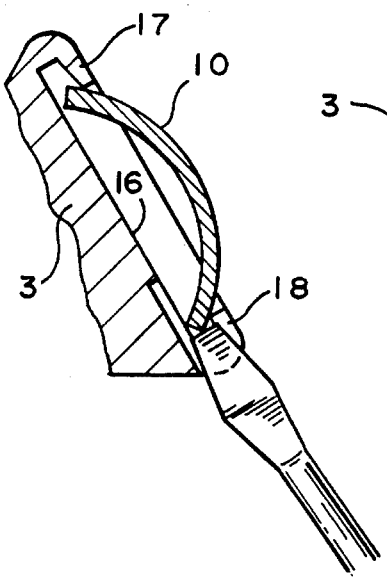
FIG. 19 is a view similar to FIG. 18 illustrating the step of removing the indicia-carry substrate from the rectangular recess.
Figure 20:
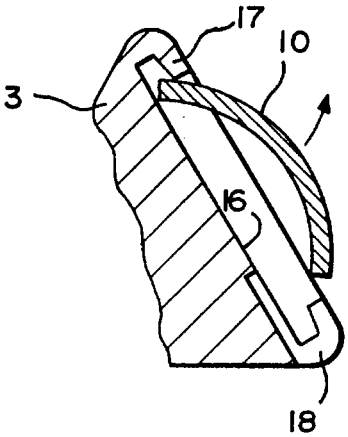
FIG. 20 is a view similar to FIG. 19 illustrating the indicia-carrying substrate being released from the rectangular recess.

A notch 18 is provided in the lower, longitudinally extending flange portion 17 for accommodating a tool 19, such as the blade of a screwdriver, so that the substrate 10 can be removed from the framed recess by inserting the screwdriver through the notch 18 to engage the lower longitudinal edge of the substrate 10 to bend the substrate 10 as shown in FIG. 19, whereby the lower longitudinal edge of the substrate is forced clear of the flange 17 as shown in FIG. 20.

From the above description, it will be readily apparent to those skilled in the art that the implement handle of the present invention provides an improved advertising display area wherein the advertising indicia can either be permanently secured to the handle, or detachably secured thereto, and by providing the handle with a polygonal portion having a plurality of flat faces to which the advertising indicia is attached, an increased viewing area is provided for catching the eye of a potential customer.

It is to be understood that the forms of the invention herewith shown and described are to be taken as preferred examples of the same, and that various changes in the shape, size and arrangement of parts may be resorted to, without departing from the spirit of the invention or scope of the subjoined claims.

We claim:

1. In combination, a handle having an advertising display area and a squeegee, said handle comprising an elongate member having an exterior surface, a gripping end portion at one end of said member, means for detachably connecting the squeegee to the opposite end portion of said member, the portion of the elongate member between the end portions thereof having a polygonal transverse cross-sectional configuration providing a plurality of flat faces on the exterior surface of said elongate member, and distinct advertising indicia connected to and displayed on each said flat face of the polygonal portion of the elongate member, whereby an increased advertising viewing area is provided for catching the eye of a potential customer.

2. The combination according to claim 1 wherein the advertising indicia is printed on a substrate said substrate being adhesively secured to said flat faces.

3. The combination according to claim 1 wherein the advertising indicia is molded on each of said flat faces so that the indicia is recessed within said faces.

4. The combination according to claim 1 wherein the advertising indicia is molded on each of said flat faces so that the indicia is raised from said faces.

5. The combination according to claim 1 wherein the elongate member is transparent and hollow, said advertising indicia being printed on a substrate, said substrate having a transverse cross-sectional configuration corresponding to the transverse polygonal cross-sectional configuration of said portion of said elongate handle, the substrate being dimensioned to be slipped into the hollow elongate member, whereby the advertising indicia is visible through each of the flat transparent faces of the polygonal portion of the handle.

6. The combination according to claim 1 wherein the advertising indicia is printed on a substrate, said substrate having a transverse cross-sectional configuration corresponding to the transverse polygonal cross-sectional configuration of said portion of said elongate handle, said substrate being hollow and dimensioned to form a sleeve slidable onto the polygonal portion of the handle.

7. The combination according to claim 1 wherein the elongate member is hollow, an aperture provided in each of the faces of the polygonal portion of said member at each end thereof, the advertising indicia being printed on a substrate strip, said strip having a hole at each end thereof alignable with said apertures, and snap fasteners extending through the aligned apertures and holes for connecting the advertising indicia to each of the faces.

8. The combination according to claim 1 wherein the elongate member is hollow, an aperture provided in each of the faces of the polygonal portion of said member at each end thereof, the advertising indicia being printed on one side of a substrate strip, a snap fastener integral with the opposite side of said strip at each end thereof, said snap fasteners extending through said apertures for connecting the advertising indicia to each of the faces.

9. The combination according to claim 1 wherein a longitudinally extending groove is provided in each of the faces of the polygonal portion of the member, the advertising indicia being printed on a substrate strip, said strip being slidable into each groove for connecting the advertising indicia to each of the faces.

10. The combination according to claim 1 wherein a longitudinally extending recess having a peripheral edge is provided in each of the faces of the polygonal portion of the member, an inwardly extending flange integral with the peripheral edge, the advertising indicia being printed on a substrate strip, said strip being inserted into each of said recesses, said flange extending over the edges of said strip to thereby form a frame for holding the advertising indicia on each of the faces.

11. The combination according to claim 10 wherein a notch is provided in a portion of the flange to facilitate the removal of the advertising indicia, whereby a tool is insertable into the notch to engage an edge of the strip for pushing the edge of the strip from underneath the flange to a released position.

12. The combination according to claim 1 wherein the polygonal cross-section is rectangular.

13. The combination according to claim 1 wherein the polygonal cross-section is triangular.

14. The combination according to claim 1 wherein the polygonal cross-section is pentagonal.

* * * * *